US005382882A

United States Patent [19]

Nerone

[11] Patent Number: 5,382,882

[45] Date of Patent: Jan. 17, 1995

[54] POWER SUPPLY CIRCUIT FOR A GAS DISCHARGE LAMP

[75] Inventor: Louis R. Nerone, Brecksville, Ohio

[73] Assignee: General Electric Company, Schenectady, N.Y.

[21] Appl. No.: 49,911

[22] Filed: Apr. 20, 1993

[51] Int. Cl.[6] ..... G05F 1/00

[52] U.S. Cl. ..... 315/307; 315/209 R; 315/219; 315/291; 315/224; 315/241 R; 315/244; 315/DIG. 5; 315/DIG. 7

[58] Field of Search ..... 315/307, 209 R, 219, 315/291, 224, 241 R, 244, DIG. 5, DIG. 7

[56] References Cited

U.S. PATENT DOCUMENTS

| | | | |
|---|---|---|---|
| 4,709,189 | 11/1987 | Kuchii | 315/DIG. 7 X |
| 5,047,690 | 9/1991 | Nilssen | 315/307 X |
| 5,134,345 | 7/1992 | El-Hamamsy et al. | 315/307 X |
| 5,208,515 | 5/1993 | Lee | 315/DIG. 7 X |
| 5,233,273 | 8/1993 | Waki et al. | 315/DIG. 7 X |

*Primary Examiner*—Robert J. Pascal
*Assistant Examiner*—Reginald A. Ratliff
*Attorney, Agent, or Firm*—George E. Hawranko; Stanley C. Corwin

[57] ABSTRACT

A power supply circuit for a gas discharge lamp is disclosed. The power supply circuit includes a circuit for providing a d.c. bus voltage on a bus conductor, and a resonant lamp circuit. The resonant lamp circuit includes a gas discharge lamp, a first resonant impedance in series with the gas discharge lamp, and a second resonant impedance substantially in parallel with the gas discharge lamp. The resonant load circuit operates at a resonant frequency determined by the values of the first and second resonant impedances. Further included is a series half-bridge converter for impressing across the resonant load circuit a bidirectional voltage, and thereby inducing a bidirectional current in the resonant load circuit. The converter comprises first and second switches that are serially connected between the bus conductor and a ground conductor, that have a common node coupled to a first end of the resonant load circuit and through which the bidirectional load current flows, and that have respective control terminals for controlling the conduction states of the switches. A circuit is provided for generating a feedback signal representing current in the second resonant impedance. Feedback circuitry, responsive to the feedback signal, provides respective control signals on the control terminals of the first and second switches. The feedback means controls the switching of the switches in such manner as to reduce a phase angle between the bidirectional voltage and the bidirectional current when the feedback signal increases, and vice-versa. Lamp power and lamp current are less subject to variation as the line voltage varies.

14 Claims, 2 Drawing Sheets

POWER SUPPLY CIRCUIT FOR A GAS DISCHARGE LAMP

FIELD OF THE INVENTION

The present invention relates to a power supply circuit for a gas discharge lamp, which is contained within a resonant load circuit supplied with bidirectional current through the operation of a pair of switches. More particularly, the invention relates to such a power supply circuit wherein control signals for the mentioned pair of switches are produced by feedback circuitry that is responsive to a feedback signal representing a current in the resonant load circuit.

BACKGROUND OF THE INVENTION

A gas discharge lamp, such as a fluorescent lamp, typically utilizes a power supply circuit to convert an a.c. line voltage to a high frequency bidirectional voltage which is impressed across a resonant load circuit containing the gas discharge lamp. The resonant load circuit includes a resonant inductor and a resonant capacitor for determining the frequency of resonance of current in the resonant load circuit. The power supply circuit includes a series half-bridge converter having a pair of switches that alternately connect one end of the resonant load circuit to a d.c. bus voltage and then to a ground, thereby impressing the mentioned bidirectional voltage across the resonant load circuit.

A prior art power supply circuit of the foregoing type is disclosed in co-pending U.S. patent application Ser. No. 08/020,275 attorney docket number LD 10,583), filed Feb. 18, 1993, entitled "Electronic Ballast Arrangement For A Compact Fluorescent Lamp," by Louis R. Nerone, the present inventor, and assigned to the present assignee and which is herein incorporated by reference. The disclosed power supply circuit utilizes feedback circuitry for controlling the mentioned pair of switches of the series half-bridge converter. The feedback circuitry operates in response to a feedback signal representing a current in the resonant load circuit.

By relying on feedback circuitry to control the switches, the power supply circuit of the foregoing patent application avoids the expense and bulk of extra circuitry for switch control. However, it would be desirable to reduce the level of variations in lamp power and lamp current that occur due to variations, for instance, in the line voltage.

A gas discharge lamp such as a low pressure fluorescent lamp, and the power supply or ballast circuit arrangement as it is more commonly known, are presently being offered on a wide scale commercial basis in a configuration that lends itself to being a viable energy efficient long life replacement for a conventional incandescent lamp. Compact fluorescent lamps as they are commonly known utilize a compact, typically multiple axis discharge vessel containing a gas fill which includes a mixture of mercury and a rare gas such as krypton or argon. The ballast circuit is contained in a housing base having an Edison Type screw base which can be installed in a conventional lamp socket. Because of the desirability of utilizing such compact fluorescent lamps as replacements for conventional incandescent lamps, it is necessary that the ballast circuit and the housing base occupy such a small space as would allow insertion in most light fixtures. To achieve this it is important that the size and quantities of the components that comprise the ballast circuit are kept to a minimum. For a discussion of the physical characteristics associated with disposing the ballast circuit within the housing base, reference is made to commonly assigned U.S. patent application Ser. No. 07/766,608 filed on Feb. 26, 1991 by Minarczyk et al. which is herein incorporated by reference.

In addition to the desirability of utilizing this improved power supply circuit for the popular compact fluorescent lamps which have an electroded arrangement for exciting the discharge, it would be advantageous if this circuit arrangement could be utilized on an electrodeless fluorescent lamp where the discharge is excited by introduction of an RF signal which is coupled to the medium through an excitation coil disposed in close proximity to the medium.

OBJECTS AND SUMMARY OF THE INVENTION

Accordingly, it is an object of the present invention to provide a power supply circuit for a gas discharge lamp which is contained within a resonant load circuit, wherein the power supply circuit utilizes feedback circuitry for controlling switches of a series half-bridge converter and wherein lamp power and lamp current are less subject to change in response to a variation in, e.g., line voltage, than is the case for the prior art circuit mentioned above.

A further object of the invention is to achieve the mentioned reduction of change in lamp power and lamp current due to variations in, e.g., line voltage, without adding componentry to the power supply circuit thereby avoiding increased cost and size variables.

The foregoing objects are realized by a power supply circuit for a gas discharge lamp, which includes means for providing a d.c. bus voltage on a bus conductor, and a resonant lamp circuit. The resonant lamp circuit includes a gas discharge lamp, a first resonant impedance in series with the gas discharge lamp, and a second resonant impedance substantially in parallel with the gas discharge lamp. The resonant load circuit operates at a resonant frequency determined by the values of the first and second resonant impedances. Further included is a series half-bridge converter for impressing across the resonant load circuit a bidirectional voltage, and thereby inducing a bidirectional current in the resonant load circuit. The converter comprises first and second switches that are serially connected between the bus conductor and a ground conductor, that have a common node coupled to a first end of the resonant load circuit and through which the bidirectional load current flows, and that have respective control terminals for controlling the conduction states of the switches. Means are provided for generating a feedback signal representing current in the second resonant impedance. A feedback means, responsive to the feedback signal, provides respective control signals on the control terminals of the first and second switches. The feedback means controls the switching of the switches in such manner as to reduce a phase angle between the bidirectional voltage and the bidirectional current when the feedback signal increases, and vice-versa.

In the foregoing power supply circuit, lamp power and lamp current are less subject to variation as line voltage varies. The circuit, moreover, can be constructed without additional componentry beyond that contained in the prior art circuit described above.

BRIEF DESCRIPTION OF THE DRAWING FIGURES

The foregoing, and further, objects and advantages of the invention will become apparent from the following description taken in conjunction with the drawing, in which.

DETAILED DESCRIPTION OF THE PREFERRED EMBODIMENTS

Figure 1:
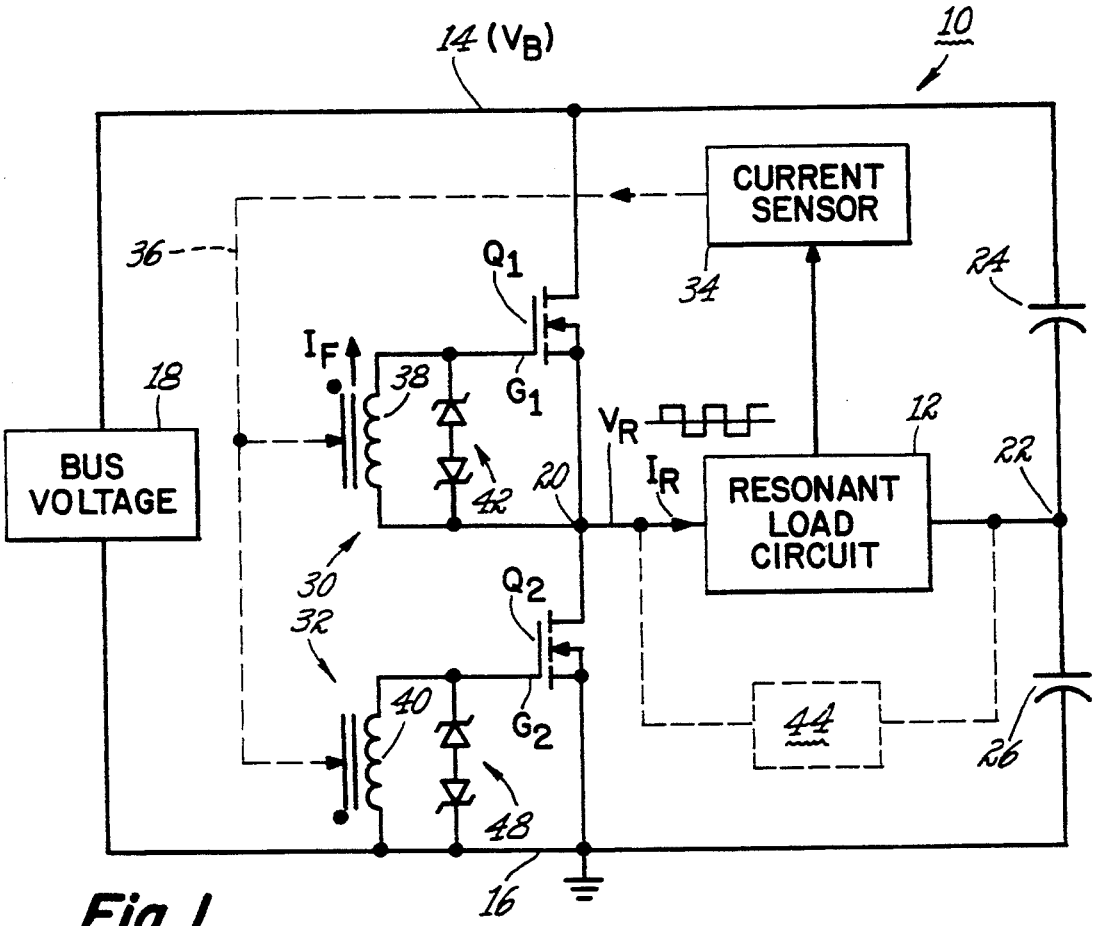
FIG. 1 is a schematic diagram, partially in block form, of a power supply circuit including feedback circuitry for controlling the conduction states of a pair of switches of a half-bridge converter.

In the drawing figures, in which like reference numerals or characters refer to like parts, FIG. 1 shows a power supply circuit 10 for a resonant load circuit 12. Resonant load circuit 12 may include a gas discharge lamp, as further described below. Electrical power for resonant load circuit 12 is provided by a bus voltage $V_B$ impressed between a d.c. bus conductor 14 and a ground conductor 16. Bus voltage $V_B$ is provided by a bus voltage generator 18, typically comprising a conventional full-wave rectifier, for rectifying a.c. voltage from an a.c. source, or line, voltage (not shown). Bus voltage generator 18, optionally, may include a power factor correction circuit, as is conventional.

Power supply circuit 10 impresses a bidirectional, resonant load voltage $V_R$ across resonant load circuit 12, from left-shown node 20 to right-shown node 22. As shown in FIG. 1, resonant load voltage $V_R$ approximates a square wave. Bidirectional, resonant load voltage $V_R$, in turn, induces a bidirectional resonant current $I_R$ through resonant load circuit 12.

To generate resonant load voltage $V_R$ from d.c. bus voltage $V_B$ on d.c. bus 14, power supply circuit 10 includes a series half-bridge converter, including series-connected MOSFETs (Metal-Oxide-Semiconductor Field-Effect Transistors), or other switches, $Q_1$ and $Q_2$. The drain of MOSFET $Q_1$ is directly connected to d.c. bus 14, and its source is connected to the drain of MOSFET $Q_2$ at node 20, which is common to switches $Q_1$ and $Q_2$. The source of MOSFET $Q_2$ is connected to ground 16. The conduction states of MOSFETs $Q_1$ and $Q_2$ are determined by respective control voltages on the respective gates $G_1$ and $G_2$ of the MOSFETs. In brief overview, bidirectional, resonant load voltage $V_R$ is generated by alternately connecting common node 20 to d.c. bus 14, which is at bus voltage $V_B$, via MOSFET $Q_1$, and then to ground 16, via MOSFET $Q_2$. Serially connected "bridge" capacitors 24 and 26, connected between d.c. bus 14 and ground 16, maintain right-shown node 22 of resonant load circuit 12 at approximately ½ of d.c. bus voltage $V_B$.

Control signals are provided on gates $G_1$ and $G_2$ of MOSFETs $Q_1$ and $Q_2$ by respective feedback circuits 30 and 32. Feedback circuits 30 and 32 are responsive to a current from part of resonant load circuit 12 that is sensed by current sensor 34. Current sensor 34 provides feedback circuits 30 and 32 with a feedback signal representing the mentioned current in resonant load circuit 12, via the dashed line shown as coupling 36.

Figure 2:
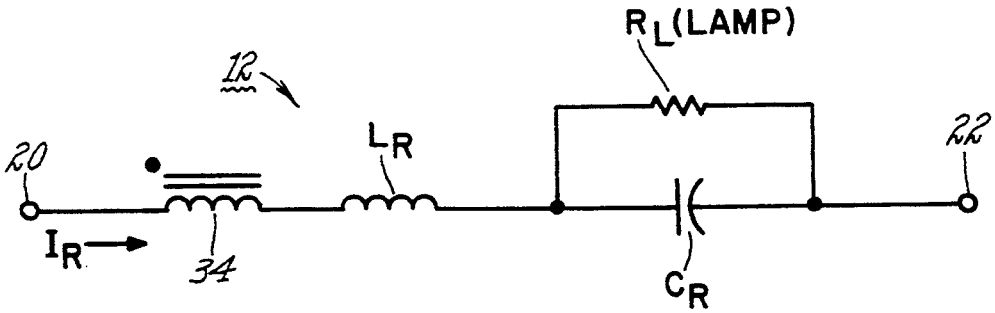
Fig. 2 (PRIOR ART)
FIG. 2 is a circuit diagram of a prior art resonant load circuit that can be used in the power supply circuit of FIG. 1.

FIG. 2 shows a prior art resonant load circuit 12 that may be used in the power supply circuit 10 of FIG. 1. This prior art resonant load circuit is described herein to facilitate understanding of the present invention.

In prior art circuit 12 (FIG. 2), a gas discharge lamp is represented as a lamp resistance $R_L$. The gas discharge lamp may be of the low pressure variety (e.g. fluorescent), or of the high pressure variety (e.g. metal halide or sodium). In order to establish a fundamental frequency of resonance in circuit 12, a resonant inductor $L_R$ and a resonant capacitor $C_R$ are included in the circuit. Resonant capacitor $C_R$ is shunted across lamp resistance $R_L$, and resonant inductor $L_R$ is serially connected to the thus-paralleled lamp resistance $R_L$ and resonant capacitor $C_R$. A current-sensing winding 34, in series with resonant inductor $R_L$, embodies current sensor 34 of FIG. 1.

Current-sensing winding 34 is mutually coupled to inductor windings 38 and 40 of FIG. 1, as indicated by coupling 36. Windings 34, 38 and 40 are poled as indicated in the drawing by dots, or, alternatively, may be oppositely poled. As shown, inductor windings 38 and 40 are coupled to each other with opposing polarities. In this manner, MOSFETs $Q_1$ and $Q_2$ are switched on (i.e. made conductive) in an alternating manner. Thus, MOSFET $Q_1$ conducts, and impresses d.c. bus voltage $V_B$ on node 20 while MOSFET $Q_2$ is off; and then MOSFET $Q_2$ is switched on, to connect node 22 to ground 16 while MOSFET $Q_1$ is off.

With inductor windings 38 and 40 coupled with opposing polarities, the operation of feedback circuits 30 and 32 will be understood from describing only circuit 30, for instance. In feedback circuit 30, a feedback current $I_F$ is generated by inductor winding 38 in response, for example, to resonant load current $I_R$ in inductor winding 34 of prior art FIG. 2. Shunted across inductor winding 38 is a pair of back-to-back (i.e. cathode-to-cathode) connected zener diodes 42. Zener diodes 42 clamp the voltage on gate $G_1$ (with respect to node 20) at a positive or a negative level with a timing determined by the polarity and amplitude of feedback current $I_F$. An inherent gate capacitance (not shown) between gate $G_1$ and node 20 also influences the behavior of feedback circuit 30.

A snubber & gate speed-up circuit 44 may be connected across resonant load circuit 12, as described below in connection with FIG. 6.

The power consumed by the gas discharge lamp (represented by lamp resistance $R_L$ in FIG. 2) is dependent on the timing of when zener diodes 42 switch the polarity of voltage on gate $G_1$. Such timing determines a phase angle between bidirectional, resonant load voltage $V_R$ and bidirectional, resonant load current $I_R$. These values determine the approximate power consumption of the lamp, according to the following equation:

$$P_L \alpha V_R' \times I_R' \times \text{cosine } \theta \quad \text{eq. (1)}$$

where $\alpha$ indicates proportionality;

$V_R'$ is the peak value of resonant load voltage $V_R$, between nodes 20 and 22;

$I_R'$ is the peak value of resonant load current $I_R$; and $\theta$ is the angle of phase difference between the fundamental frequency components of resonant load voltage $V_R$ and resonant load current $I_R$.

An increase in the resonant load voltage $V_R$, due, for instance, to a line voltage increase, proportionately increases the maximum value of resonant load voltage, $V_R'$. From equation 1, above, it can be seen that lamp power $P_L$ proportionately increases. (This proportionate increase due to increasing line voltage also holds true for the present invention, described below.) Additionally, as bus voltage $V_B$ increases due to a line voltage increase, for instance, resonant load current $I_R$ (FIG. 2) also increases. Using the location for sensing current in prior art resonant load circuit 12 (FIG. 2), feedback current $I_F$ in feedback circuit 30 (FIG. 1), in turn, increases.

Figure 3:
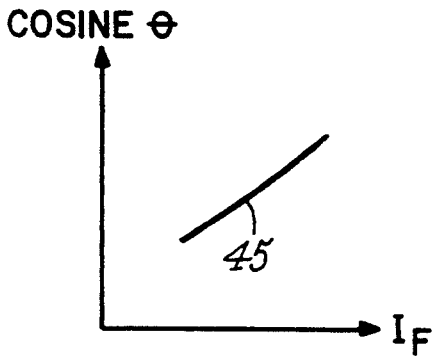
FIG. 3 is a simplified graph showing the variation in the cosine of a phase angle between a bidirectional voltage across, and a bidirectional current through, the resonant load circuit of FIG. 1 versus a feedback current used in the power supply circuit of FIG. 1.

An increase in feedback current $I_F$, in turn, influences the timing of when zener diodes 42 clamp gate $G_1$ to either a positive, or a negative, voltage, which affects the angle $\theta$ contained in equation 1 above. The relationship between the cosine of angle $\theta$ amplitude and the amplitude of feedback current $I_F$ in feedback circuit 30 is depicted by a simplified curve 45 shown in FIG. 3. As FIG. 3 indicates, increasing feedback current $I_F$ results in an increasing cosine of angle $\theta$. In terms of equation 1 above, an increase in bus voltage $V_B$ not only proportionately increases the maximum resonant load voltage $V_R'$, but also increases the cosine of angle $\theta$ when using the positioning of current-sensing inductor winding 34 of prior art FIG. 2.

Figure 4:
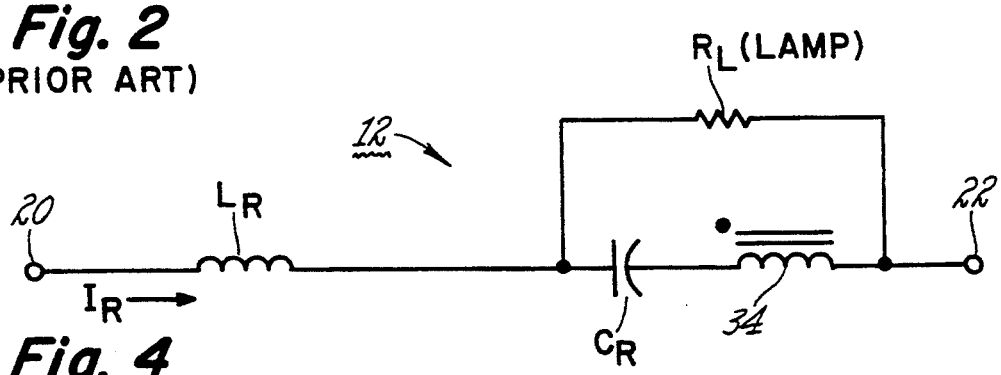
FIG. 4 is a circuit diagram of a resonant load circuit according to the invention, that may be used in the power supply circuit of FIG. 1.
Figure 5:
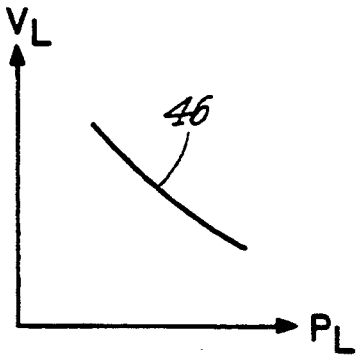
FIG. 5 is a simplified graph showing the variation in lamp voltage versus lamp power.

The present invention is particularly directed towards reducing the component of increased lamp power arising from the cosine of angle $\theta$ term in equation 1 above. FIG. 4 shows one embodiment of a resonant load circuit 12 that can be used in inventive combination with power supply circuit 10 of FIG. 1. FIG. 4 shows lamp resistance $R_L$, resonant capacitor $C_R$ and resonant inductor $L_R$ in a generally similar circuit arrangement as shown in FIG. 2. However, in FIG. 4, current-sensing winding 34 has been relocated to form a serial circuit with resonant capacitor $C_R$, which circuit is substantially in parallel with lamp resistance $R_L$. The placement of current-sensing winding 34 in FIG. 4 takes advantage of the property of a gas discharge lamp of decreasing in voltage with increasing power consumption, over a normal operating range. This relation is shown by the negative slope of a simplified curve 46 in FIG. 5, plotting voltage across a lamp, $V_L$, with respect to lamp power $P_L$. Such decreasing voltage with increasing power is related to a decreasing lamp resistance $R_L$ with increasing lamp power $P_L$.

Returning to FIG. 4, an increase in d.c. bus voltage $V_B$ (FIG. 1) due to a line perturbation, for instance, tends to increase lamp power. However, since lamp voltage $V_L$ decreases, as shown in FIG. 5, the current sensed in current-sensing winding 34 correspondingly decreases. With the proportionate feedback current $I_F$ also decreasing, the curve of FIG. 3 indicates that the cosine of angle $\theta$ also decreases. As a result, an increase in lamp power $P_L$ due to increasing line voltage is limited by a concurrent decrease in the cosine of angle $\theta$ term of equation 1 above.

For a fluorescent lamp rated at 11 watts, with a 600 lumen output at a nominal line voltage of 230 volts a.c., use of the prior art resonant load circuit 12 of FIG. 2 resulted in a ratio of the change in input power (a measure of lamp power) to the change in line voltage of 1.61. Thus, a ten percent increase in line voltage results in a 16.1 percent increase in input power. In contrast, using the inventive arrangement of FIG. 4, the change in input power to the change in input voltage, for an otherwise identical circuit, was 0.97, a considerable decrease. The foregoing change-in-power to change-in-line voltage ratio expresses the sensitivity of lamp power to line voltage.

A decrease in the ratio of the change in lamp current to the change in line voltage was also observed. The prior art circuit of FIG. 2 yielded such change-in-current to change-in-voltage ratio of 2.89, whereas the inventive circuit of FIG. 4 yielded a markedly decreased, corresponding ratio of 1.25. The foregoing change-in-lamp current to change-in-line voltage ratio expresses the sensitivity of lamp current to line voltage.

The decreased power and current sensitivities to changes in line voltage assures that a gas discharge lamp will be less stressed from changes in line voltage, as well as from changes in the values of the components of the power supply circuit (e.g. a change in the inductance value of resonant inductor $R_L$). Longer lamp life results.

The above-mentioned sensitivity values were obtained from a circuit using IRFR310-model MOSFETs $Q_1$ and $Q_2$ from the International Rectifier Corporation of El Segundo, Calif. under their trademark HEXFET. The upper and lower diodes of the zener diode pair 42 (FIG. 1) were respectively rated at 7.5 and 10 volts. A corresponding back-to-back zener diode pair 48 of feedback circuit 32 had the same respective values. Inductor winding 34 of the prior art resonant load circuit 12 (FIG. 2) had 4 turns, and the winding 34 of the inventive circuit of FIG. 4 had 16 turns. The number of turns for each of inductor windings of 38 and 40 was 40. Resonant capacitor $C_R$ of both prior art FIG. 2 and inventive FIG. 4 was rated at 2.2 nanofarads. Resonant inductor $C_R$ of both prior art FIG. 2 and FIG. 4 was rated 1.2 millihenries. Bridge capacitors 24 and 26 were both rated at 47 nanofarads.

Figure 6:
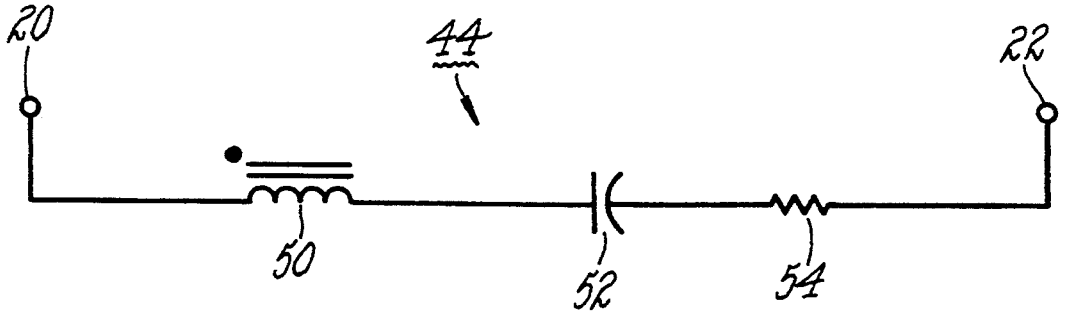
FIG. 6 is a circuit diagram of a snubber & gate speed-up circuit that may be used in the power supply circuit of FIG. 1.

The above-mentioned comparison was performed with a power supply circuit 10 (FIG. 1) utilizing a snubber & gate speed-up circuit 44, as shown in FIG. 6. The mentioned reduction in input power and lamp current sensitivities, however, are achieved irrespective of the presence or absence of snubber & gate speed-up circuit 44.

Snubber & gate speed-up circuit 44 is connected between nodes 20 and 22, and hence in parallel with resonant load circuit 12. Circuit 44 comprises, in serial connection, an inductor winding 50, a capacitor 52 and a resistor 54. Winding 50 is mutually coupled to current-sensing winding 34 of either of prior art FIG. 2 or inventive FIG. 4, and had 5 turns. Capacitor 52 had a value of 470 picofarads, and resistor 54 a value of 22 ohms. Resistor 54 serves to reduce parasitic interaction between capacitor 52 and other reactances coupled to it.

Capacitor 52 operates, first, in a so-called snubbing mode, wherein it stores energy from resonant load circuit 12 during an interval in which one of MOSFETs $Q_1$ and $Q_2$ has turned off, but the other has not yet turned on. The energy stored in capacitor 52 is thereby diverted from MOSFETs $Q_1$ and $Q_2$, which, in the absence of snubbing capacitor 52, would dissipate such energy in the form of heat while switching between conductive and non-conductive states. Further details of the snubbing role of capacitor 52 are described in co-pending U.S. patent application Ser. No. 08/020,275 (attorney docket no. LD 10,583), filed Feb. 18, 1993, entitled "Electronic Ballast Arrangement for a Compact Fluorescent Lamp", by Louis R. Nerone.

Capacitor 52, secondly, operates to increase the speed of switching of MOSFETs $Q_1$ and $Q_2$. In this role, capacitor 52 creates a speed-up pulse when a rising current in the capacitor, induced in winding 50, occurs. The rising current is induced in winding 50 from rising current in current-sensing winding 34 of prior art FIG. 2 or inventive FIG. 4. Further details of this gate speed-up role of capacitor are described in the foregoing patent application of Louis R. Nerone.

Figure 7:
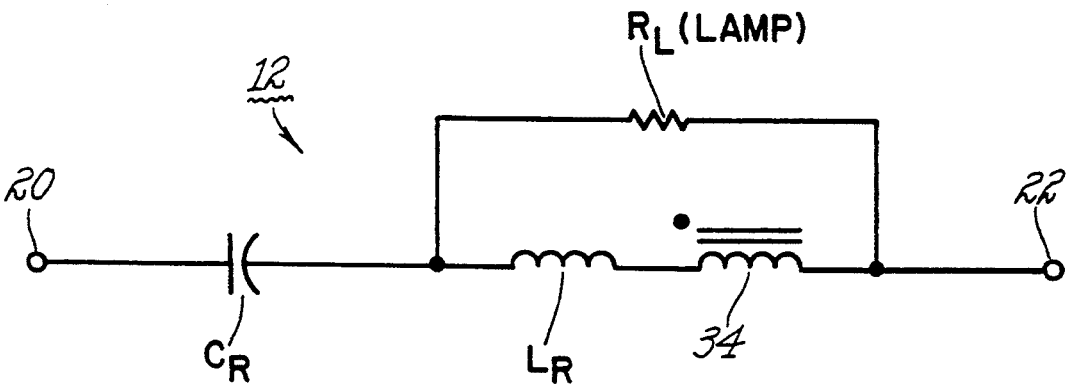
FIG. 7 shows an alternative embodiment of a resonant load circuit, according to the invention, that may be used in the power supply circuit of FIG. 1.

FIG. 7 shows another inventive resonant load circuit 12, differing from the inventive FIG. 4 circuit in that the locations of resonant capacitor $C_R$ and resonant inductor $L_R$ are interchanged. In the FIG. 7 circuit, current through current-sensing winding 34 decreases, as does the current in current-sensing winding 34 of the FIG. 4 circuit, with an increase in line voltage. This is due to the decreasing voltage across the lamp $V_L$ with increasing lamp power, as shown in FIG. 5. The FIG. 7 circuit, therefore, exhibits the same phenomenon of feedback current $I_F$ in feedback circuit 30 (FIG. 1) decreasing with increasing line voltage, to achieve a lower value of the cosine of angle $\theta$. As described in connection with equation 1 above, a decrease in such cosine term reduces the overall increase in lamp power.

While the invention has been described with respect to specific embodiments by way of illustration, many modifications and changes will occur to those skilled in the art. For instance, digital circuitry could perform various of the functions in the above-described power supply circuit that are described herein as performed by discrete components. It is therefore, to be understood that the appended claims are intended to cover all such modifications and changes as fall within the true spirit scope and scope of the invention.

What is claimed is:

1. A power supply circuit for a gas discharge lamp, comprising:

(a) means for providing a d.c. bus voltage on a bus conductor;

(b) a resonant load circuit including a gas discharge lamp, a first resonant impedance in series with said gas discharge lamp, and a second resonant impedance in parallel with said discharge lamp; said resonant load circuit operating at a resonant frequency determined by the values of said first and second resonant impedances;

(c) a series half-bridge converter for impressing across said resonant load circuit a bidirectional voltage, and thereby inducing a bidirectional current in said resonant load circuit; said converter comprising first and second switches serially connected between said bus conductor and a ground conductor, having a common node coupled to a first end of said resonant load circuit and through which said bidirectional current flows, and having respective control terminals for controlling the conduction states of said switches;

(d) means for generating a feedback signal as a function of at least a portion of the current in said second resonant impedance of said resonant load circuit;

(e) feedback means, responsive to said feedback signal, for providing respective control signals on said control terminals of said first and second switches; said feedback means being effective for controlling the switching of said switches in such a manner as to reduce a phase angle between said bidirectional voltage and said bidirectional current when said feedback signal increases, and vice-versa; and, (f) wherein said means for generating said feedback current comprises a first inductor winding serially connected to said second resonant impedance, with said gas discharge lamp connected in parallel with the series combination of said second resonant impedance and said gas discharge lamp.

2. The power supply circuit of claim 1, wherein said first and second resonant impedances respectively comprise a resonant inductance and a resonant capacitance.

3. The power supply circuit of claim 1, wherein said series half-bridge converter further comprises means for maintaining a second end of said resonant load circuit at approximately half the d.c. bus voltage.

4. The power supply circuit of claim 3, wherein said means for maintaining a second end of said resonant load circuit at approximately half the d.c. bus voltage comprises a pair of capacitors serially connected between said bus and ground conductors and having a common node coupled to said second end of said resonant load circuit.

5. The power supply circuit of claim 1, wherein said means for generating said feedback signal further comprises a second inductor winding mutually coupled to said first inductor winding and being coupled to one of said switch control terminals.

6. The power supply circuit of claim 5, wherein said feedback means further comprises a pair of back-to-back zener diodes shunted across said second inductor winding.

7. The power supply circuit of claim 5, wherein said means for generating said feedback signal further comprises a third inductor winding mutually coupled to said first inductor winding, with opposite polarity from said second inductor winding, and being coupled to another of said switch control terminals.

8. The power supply circuit of claim 1, wherein said gas discharge lamp comprises a fluorescent lamp.

9. The power supply circuit of claim 1, further comprising means for generating a speed-up signal for increasing the speed of switching of said switches.

10. The power supply circuit of claim 9, wherein said means for generating a speed-up signal comprises:

(a) a speed-up circuit shunting said resonant load circuit and having current means to induce therein a current representing current in said second resonant impedance;

(b) a capacitor serially connected to said current means and having an impedance selected to create a speed-up pulse; and (c) means for coupling said speed-up pulse to said feedback means.

11. The power supply circuit of claim 1 wherein said first and second resonant impedances respectively comprise a resonant capacitance and a resonant inductance and wherein said generating means generates said feedback signal as a function of the current in said second resonant impedance.

12. A gas discharge lamp and ballast circuit arrangement operable using line power and comprising:

means for conditioning said line power to a d.c. voltage made available over a d.c. bus conductor;

a resonant load circuit including a first resonant impedance and a second resonant impedance one of which is in series with a lamp load representing an impedance associated with the gas discharge lamp, said resonant load circuit operating at a resonant frequency determined by the values of said first and second resonant impedances;

a converter circuit electrically coupled to said resonant load circuit so as to impress a bi-directional voltage thereacross and thereby induce a bi-directional current in said resonant load circuit, said converter circuit including first and second switches serially connected between said bus conductor and ground and having a common node coupled to a first end of said resonant load circuit and through which said bi-directional load current flows;

means for generating a feedback signal representative of at least a portion of the current flowing in said resonant load circuit;

control means responsive to said feedback signal and effective for controlling said first and second switches so as to reduce a phase angle between said bi-directional voltage and said bi-directional current;

means for generating a speed up signal for increasing the speed of switching of said switches; and, wherein said means for generating said speed up signal comprises a speed-up circuit shunting said resonant load circuit and having current means to induce therein a current representing current in said second resonant impedance, a capacitor serially connected to said current means and having an impedance selected to create a speed-up pulse, and, means for coupling said speed-up pulse to said feedback means.

13. The gas discharge lamp and ballast circuit arrangement of claim 12 wherein said gas discharge lamp is an electroded, low pressure fluorescent lamp.

14. The gas discharge lamp and ballast circuit arrangement of claim 12 wherein said gas discharge lamp is an electrodeless fluorescent lamp.

* * * * *